United States Patent [19]

Wicks, III et al.

[11] 4,064,572

[45] Dec. 27, 1977

[54] LEVEL ACTUATED APPARATUS FOR DELIVERING CHEMICALS

[75] Inventors: Moye Wicks, III; Hans E. Kubitschek; William E. King, all of Houston, Tex.

[73] Assignee: Shell Oil Company, Houston, Tex.

[21] Appl. No.: 687,833

[22] Filed: May 19, 1976

[51] Int. Cl.[2] ..... E03D 9/03

[52] U.S. Cl. ..... 4/227; 4/228

[58] Field of Search ..... 4/223, 225, 226, 228, 4/231, 227; 137/268

[56] References Cited

U.S. PATENT DOCUMENTS

| | | | |
|---|---|---|---|
| 3,407,412 | 10/1968 | Spear | 4/228 |
| 3,444,566 | 5/1969 | Spear | 4/228 |
| 3,890,657 | 6/1975 | Gray | 4/228 X |

*Primary Examiner*—Richard E. Aegerter
*Assistant Examiner*—Frederick R. Schmidt

[57] ABSTRACT

An apparatus for metering a small, measured amount of liquid chemicals, actuated by the effect of a cycling fluid level upon an air pump chamber connected to a chamber containing soluble, solid chemicals.

7 Claims, 10 Drawing Figures

FIG. 1
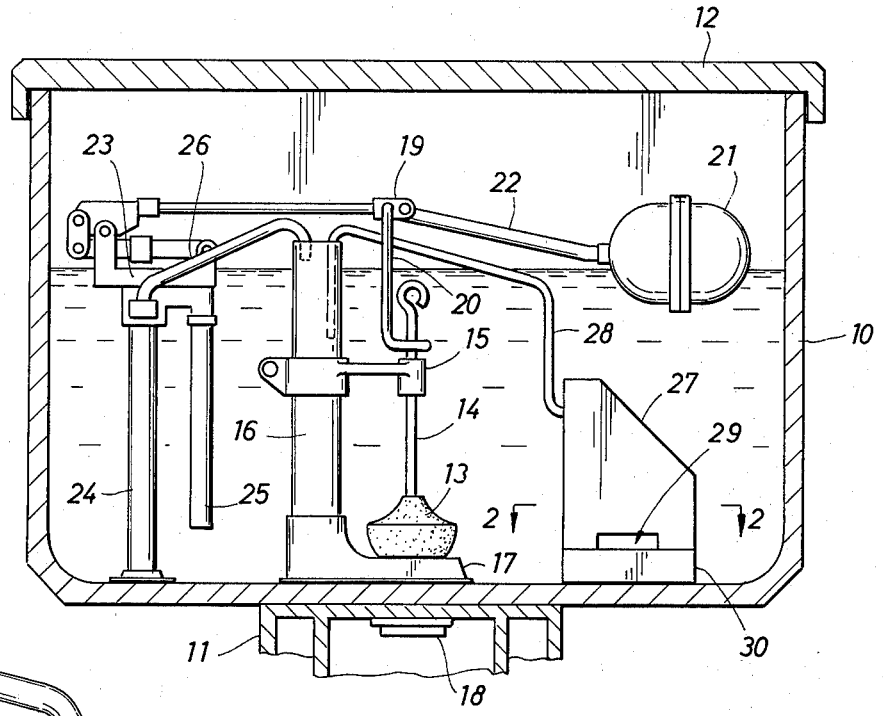
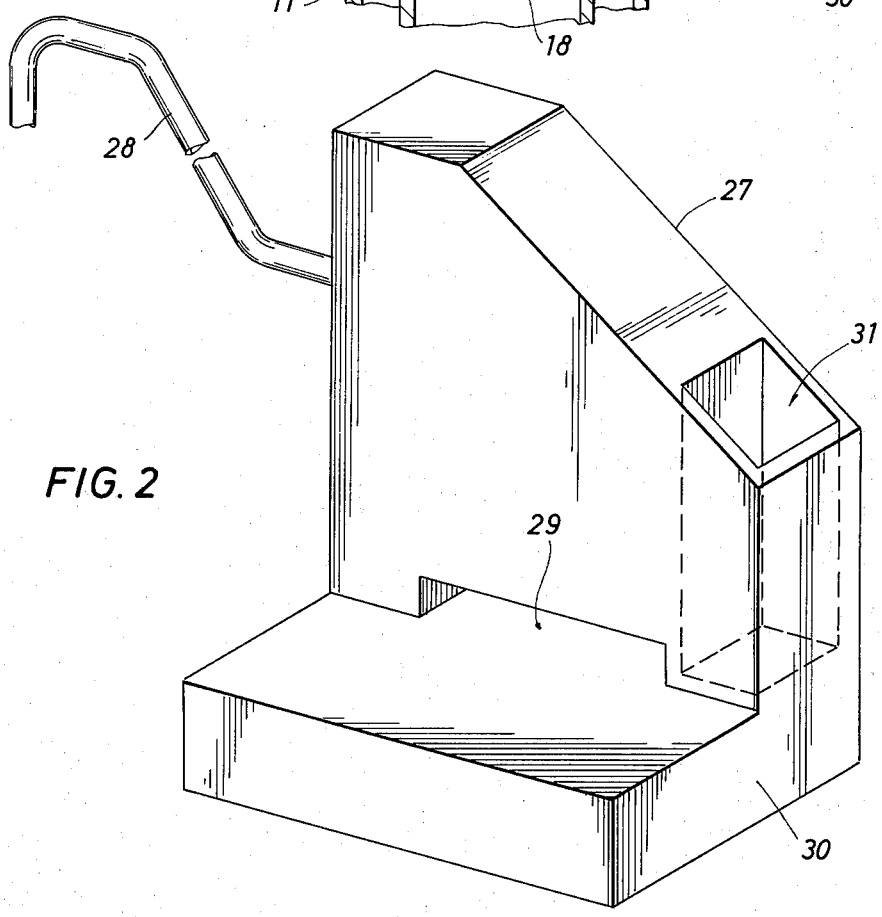
FIG. 2

FIG. 3
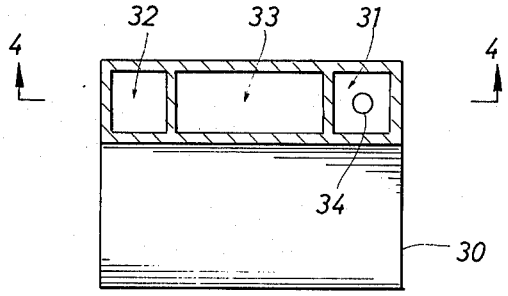
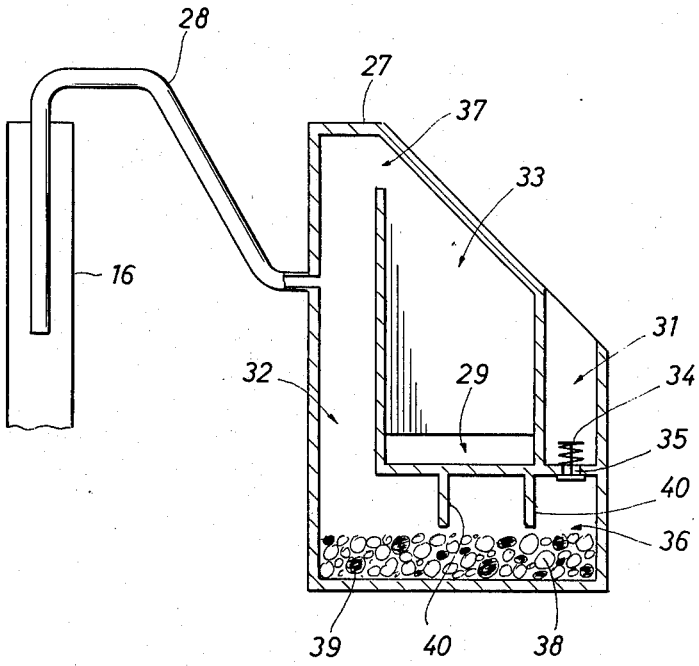
FIG. 4
FIG. 5
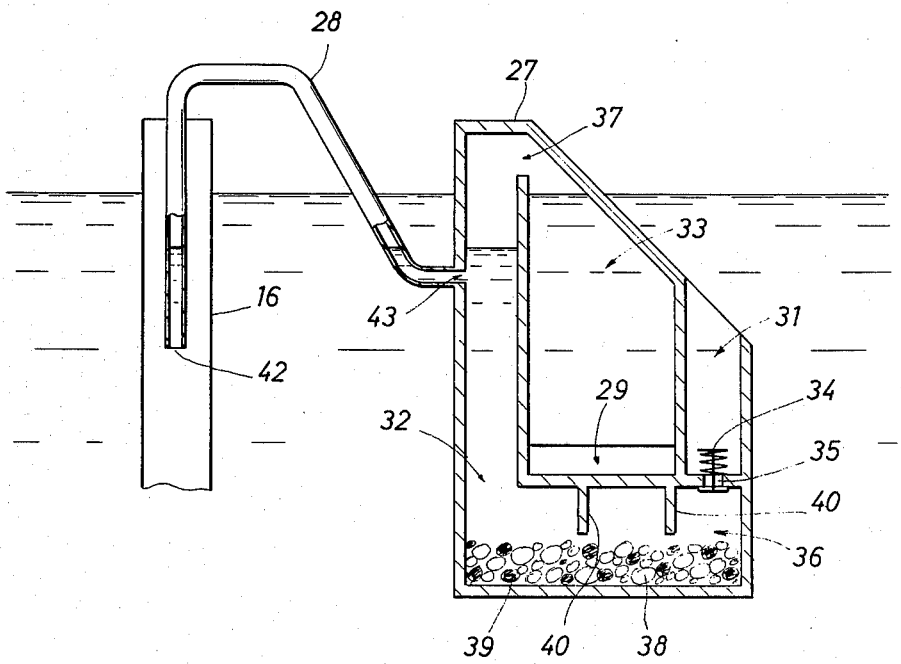

LEVEL ACTUATED APPARATUS FOR DELIVERING CHEMICALS

BACKGROUND OF THE INVENTION

1. Field of the Invention

This invention relates to that class of apparatus which delivers a metered amount of chemicals upon actuation of a cycling fluid level. In particular, the apparatus of this invention is useful for metering a small measured amount of a liquid disinfectant, deodorant, cleaner or the like, into a toilet bowl trap at the conclusion of the flushing cycle.

2. Description of the Prior Art

An apparatus for metering small, measured amounts of chemicals upon actuation by a cycling fluid which would be relatively simple in design, easy to manufacture, having few moving parts and which would be easy to install would find use in both industry and in the consumer products area. Industrial applications would include, for example, the metering into a liquid batch reactor of a small amount of a homogeneous catalyst during each batch cycle of the reactor, or metering into a liquid storage tank a small amount of corrosion inhibitor during each empty-fill cycle. In the consumer products area this apparatus would be useful for supplying a disinfectant, deodorant, cleaner or the like into the toilet bowl trap at the end of the flushing cycle.

Numerous attempts have been made in the prior art to supply chemical disinfectants and the like to toilet bowls, during or after the flushing cycle. Some of these prior art devices employ valves and springs and other mechanical parts which are complex and costly and one such example is shown in U.S. Pat. No. 2,761,151, Ferrando.

A common failing of the prior art resides in the failure to recognize the rather large amount of water which passes through the small refill tube or bypass tube commonly extending between the water inlet and overflow pipes of the flush tank during the flushing operation. The main purpose of this refill tube is is to assure that the bowl trap is refilled with water prior to the next flush. However, in practice, the refill tube supplies significantly more water to the trap than is required to fill it, with the result that any chemical or the like supplied to the trap prior to the closing of the water inlet valve in the tank is generally washed out of the trap and lost down the sewer. Most of the prior art schemes dealing with the problem have completely lost sight of this problem. Examples are U.S. Pat. Nos. 3,084,350, Anderson; 3,001,210, Diehl; and 2,853,715, Ratcliffe. Another problem with prior art devices is that complex design makes them difficult to install. Illustrative of the class are the devices shown in U.S. Pat. Nos. 3,407,412 & 3,444,566 to Spear. These devices require special attachment to the standpipe and bypass tube of a toilet flush tank. Such installation complexities inhibit penetration of such a device into the consumer products market.

SUMMARY OF THE INVENTION

The present invention provides for apparatus containing therein soluble solid chemicals and of which a measured solution of said chemicals are delivered upon actuation of a novel air pump by a cycling fluid level. In a preferred embodiment, the apparatus of this invention is useful for delivering small measured amounts of a liquid disinfectant, deodorant and/or cleaner or the like into a toilet bowl trap at the conclusion of the flushing cycle. Advantages of this apparatus are simplicity of design, minimum of moving parts, ease of installation and economy and maximum utilization of chemicals.

BRIEF DESCRIPTION OF THE DRAWING

In the accompanying drawings forming a part of this application and in which like numerals are employed to designate like parts throughout the same:

FIG. 1 is a fragmentary vertical section through a toilet flush tank and mechanism equipped with the apparatus of the present invention.

FIG. 2 is an isometric view of a preferred embodiment of the apparatus of this invention as illustrated in FIG. 1.

FIG. 3 is an enlarged plan view of the invention taken substantially on line 2—2 of FIG. 1.

FIG. 4 is a vertical section veiw taken substantially on line 3—3 of FIG. 3.

FIG. 5 is a vertical sectional view taken substantially on line 3—3 of FIG. 3 and illustrating one condition of operation of the invention.

DESCRIPTION OF THE PREFERRED EMBODIMENTS

Figure 6:
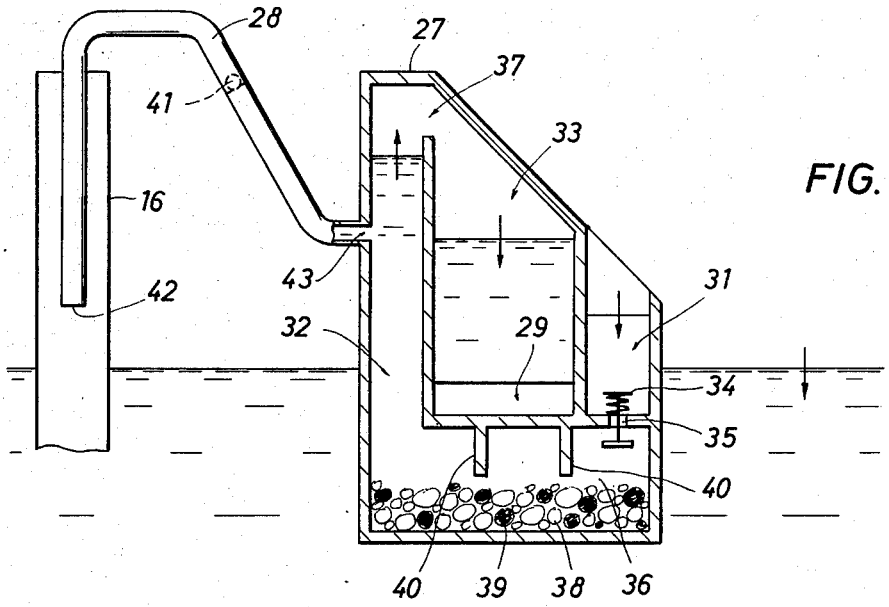
FIGS. 6, 7 and 8 are sectional views similar to FIG. 5 illustrating second, third, and fourth condition of operation.

In the drawings, wherein for the purpose of illustration and not for the purpose of limiting the invention is shown a preferred embodiment of the invention, attention is directed first to FIG. 1, wherein the numeral 10 designates the usual toilet flush tank mounted upon an extension 11 of the toilet bowl or stool or upon an independent support, in some instances. The tank 10 customarily has a removable cover 12, as shown. The conventional flush mechanism within the tank 10 includes the usual manually elevated ball valve 13 whose vertical stem 14 is guided by a short sleeve 15 mounted upon the adjacent upright overflow pipe 16 whose open top assures that the water level within the tank cannot rise above a predetermined maximum point. The lower end of the overflow pipe 16 communicates with a chambered seat 17 for the ball valve 13, said seat communicating directly with the outlet flush pipe 18 coupled with the toilet bowl, not shown. As is well known, when it is desired to flush the toilet, the ball valve 13 is unseated by manipulating a handle on the exterior of the flush tank, not shown, said handle connected with a lever 19, in turn connected with a link 20 which is capable of lifting the stem 14 of the ball valve.

When the ball valve 13 is thus unseated, the water in the tank 10 rushes by gravity through the pipe 18 to flush out the toilet bowl. When this occurs, the conventional float 21 within the tank carried by a float arm 22 causes opening of a water inlet valve 23 mounted atop an upstanding water inlet pipe 24 connected in and leading through the bottom wall of the tank 10. The incoming water to refill the tank 10 is directed downwardly toward the bottom of the tank by a depending inlet pipe extension 25. This arrangement reduces turbulence. Incoming water is also directed from water inlet valve 23 through bypass or refill tube 26 to the top of overflow pipe 16. This arrangement assures that the toilet bowl will be filled with water after ball valve 13 has been reseated.

The ball valve 13 is reseated automatically after the flushing water drains from the tank 10, and the float 21 begins to rise slowly as the tank refills itself. The valve 23 remains open until the water level in the tank 10 reaches a predetermined level regulated by the float 21, usually slightly below the top of overflow pipe 16. When this desired level is achieved, the float 21 causes the inlet valve 23 to close and the entire flushing and refilling cycle is completed.

The apparatus of this invention 27 is relatively small compared to the flush tank 10 and rests upon the bottom of flush tank 10. Siphon discharge tube 28 leads from apparatus 27 to the top of stand pipe 16. Tank 30 of apparatus 27 contains appropriate chemical solids 38 (FIG. 4) and ballast 39 (FIG. 4) as is necessary to provide sufficient weight to apparatus 27 to allow it to rest on the bottom of flush tank 10.

FIG. 2 is an isometric view of apparatus 27 of FIG. 1 illustrating refill opening 31 through which water is drawn to replace fluid discharge to siphon discharge tube 28. Solids/ballast tank 30 can be of various sizes and shapes and is not a critical limitation of this invention and depends, among other things, upon the amount of solid chemical storage required and ballast, if any, needed, solubility rates for given chemicals, volume of chemical to be delivered, cycle times, etc.

FIG. 3 shows the relationship between opening of refill chamber 31, air pump chamber 33 and discharge tower chamber 32. Check valve 34 leading from refill chamber 31 to solids/ballast tank 30 is also shown.

FIG. 4 shows the interconnecting relationship between the refill chamber 31, check valve 34, opening 35 between refill chamber 31 and solids/ballast chamber 36, discharge tower chamber 32, opening 37 between discharge tower 32 and air pump 33. Chemical solids 38 and if necessary ballast 39 are contained in solids/ballast chamber 36. One or more baffles 40 are optionally provided to insure that the entering fresh water displaces the concentrated solution generated by chemical solids 38 is displaced into discharge tower chamber 38 rather than the lighter fresh water moving across the top of the denser concentrated solution and directly into discharge tower chamber 38. By appropriate design of chamber 36 and with relatively slow discharge cycles, the baffles 40 can be eliminated because molecular diffusion will effect mixing as water moves slowly from refill chamber 31 towards discharge tower chamber 32.

FIGS. 5, 6, 7, and 8 illustrate the operation at the apparatus of this invention in its preferred embodiment as a toilet bowl chemical dispenser. FIG. 5 shows water levels in the toilet bowl tank and apparatus at the tank-full situation. When the tank lever is tripped, the water level falls very rapidly as shown in FIG. 6. During this phase the air pump 33 provides suction which causes check valve 34 to open allowing fresh water to be drawn from refill chamber 31, through opening 35 into solids/ballast chamber 36 and up into discharge tower chamber 32. This continues until the water level reaches the air pump opening 29 at which point the air pump 33 empties rapidly of water through opening 29. Means must be provided at siphon discharge tube 28 to prevent air from being drawn back through siphon discharge tube instead of water being drawn through refill chamber 31. In one embodiment, a check valve 41 is provided in the siphon discharge tube 28 to prevent air back flow.

In the preferred embodiment of the invention wherein the invention is used as a toilet bowl chemical dispenser, it has been found that if the siphon discharge tube 28 extends down to within at least about four inches of the bottom of the overflow pipe 16, then as the tank drains a venturi effect created in the overflow pipe 16 as the rushing water passes quickly by the opening at the bottom of the overflow pipe 16 results in a partial suction or vacuum which is transmitted to the end of siphon discharge tube 28 and which is sufficient to prevent air back flow without the use of a check valve but which is not so great as to initiate the siphon effect. The location of the end 42 of siphon discharge tube 28 needed to provide the necessary negative pressure can be readily determined by persons having ordinary skill in the art. The location of end 42 will vary with different makes and models of toilets. Although applicants have found that end 42 must be within about four inches of the bottom of overflow pipe 16 for most toilets, it is possible in an extreme case for the distance to be greater than four inches which would still be considered to be within the scope of the present invention.

Figure 7:
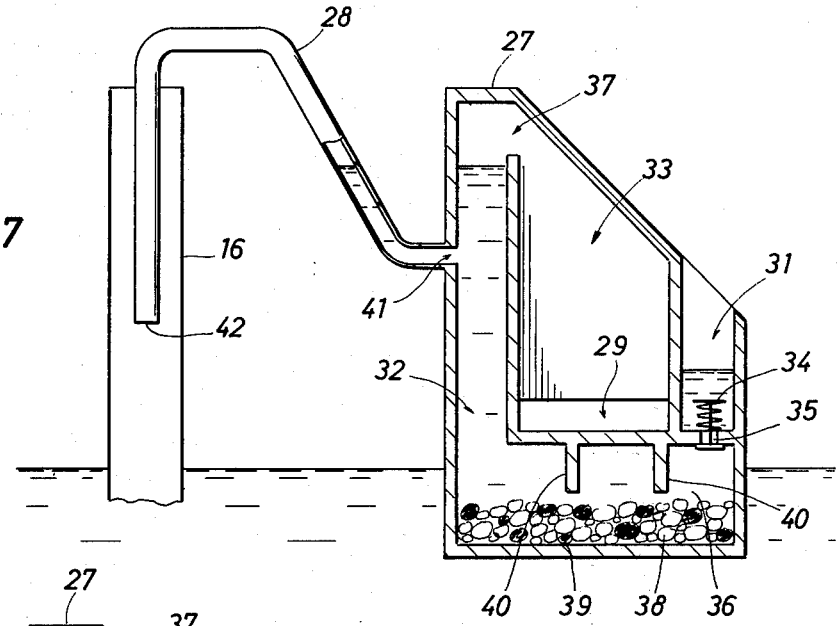

FIG. 7 is illustrative of the state of the apparatus of the bottom of the flushing cycle. The difference in height between the water level in the discharge tower chamber 32 and the refill chamber 31 causes check valve 34 to close.

Figure 8:
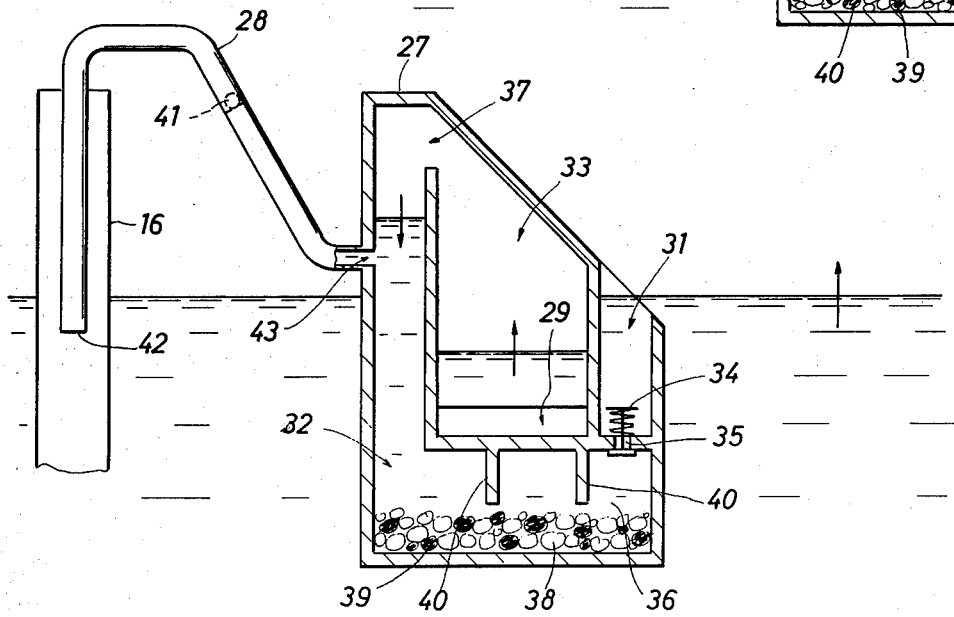

FIG. 8 illustrative of the start of the apparatus as the toilet bowl tank is refilling with water. As the water level rises, it seals off the opening 29 at the air pump chamber 33 and positive air pressure is generated. Check valve 34 is kept in the closed position and check valve 41, if present in a particular embodiment, is opened and water is forced into the siphon discharge tube 28. Because the exit 42 of the siphon discharge tube 28 is lower than the opening 43 of the siphon discharge tube 28, a siphon is initiated and discharge tower chamber 32 is drained to the level of opening 43 at which point the siphon is broken. Because the siphon effect occurs only after tank valve 13 (FIG. 1) is closed and the tank is refilling, all of the toilet bowl chemical is directed into the toilet bowl through the overflow pipe 16, resulting the most effective utilization of the toilet bowl chemical. The volume of chemical delivered is determined by the geometries of refill chamber 31, and discharge tower chamber 32. These geometries are varied between wide limits to provide a wide range of volume. These variations can readily be determined by persons possessing ordinary skill in the art. Other design parameters such as location and size of air pump opening 29, geometry of air pump 33, discharge tower chamber 32 and refill chamber 31 for the particular use envisioned are readily determined by routine experiments or calculations by persons having ordinary skill in the art.

Figure 9:
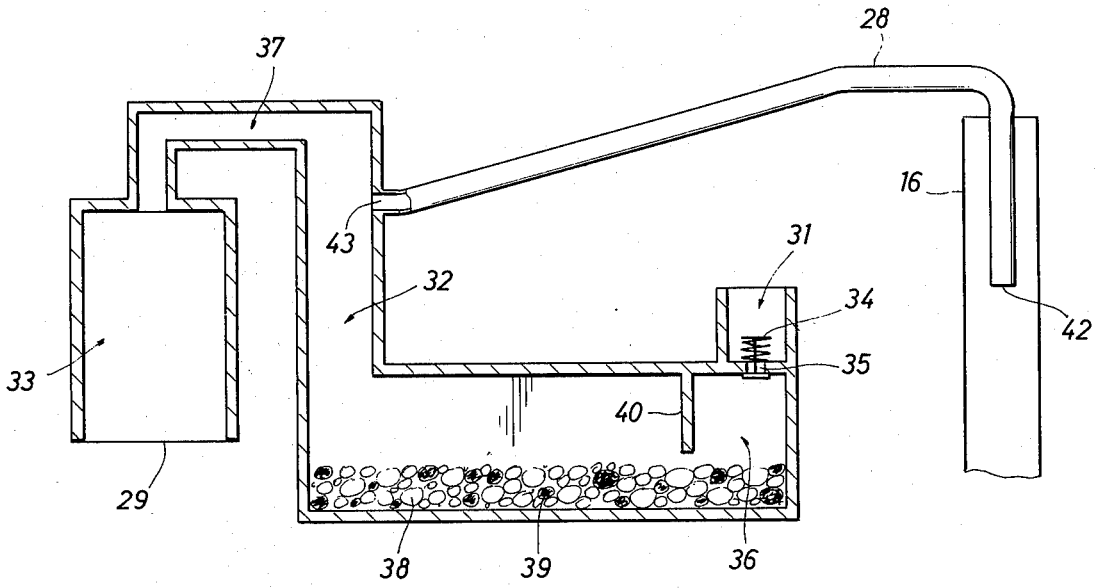
FIG. 9 is a vertical section view of an alternate configuration at the apparatus of this invention.

FIG. 9 shows an alternate geometric arrangement, thereby illustrating that the particular configural arrangements of the basic elements of this invention are not critical and can be varied from that arrangement illustrated in FIGS. 1–8.

Figure 10:
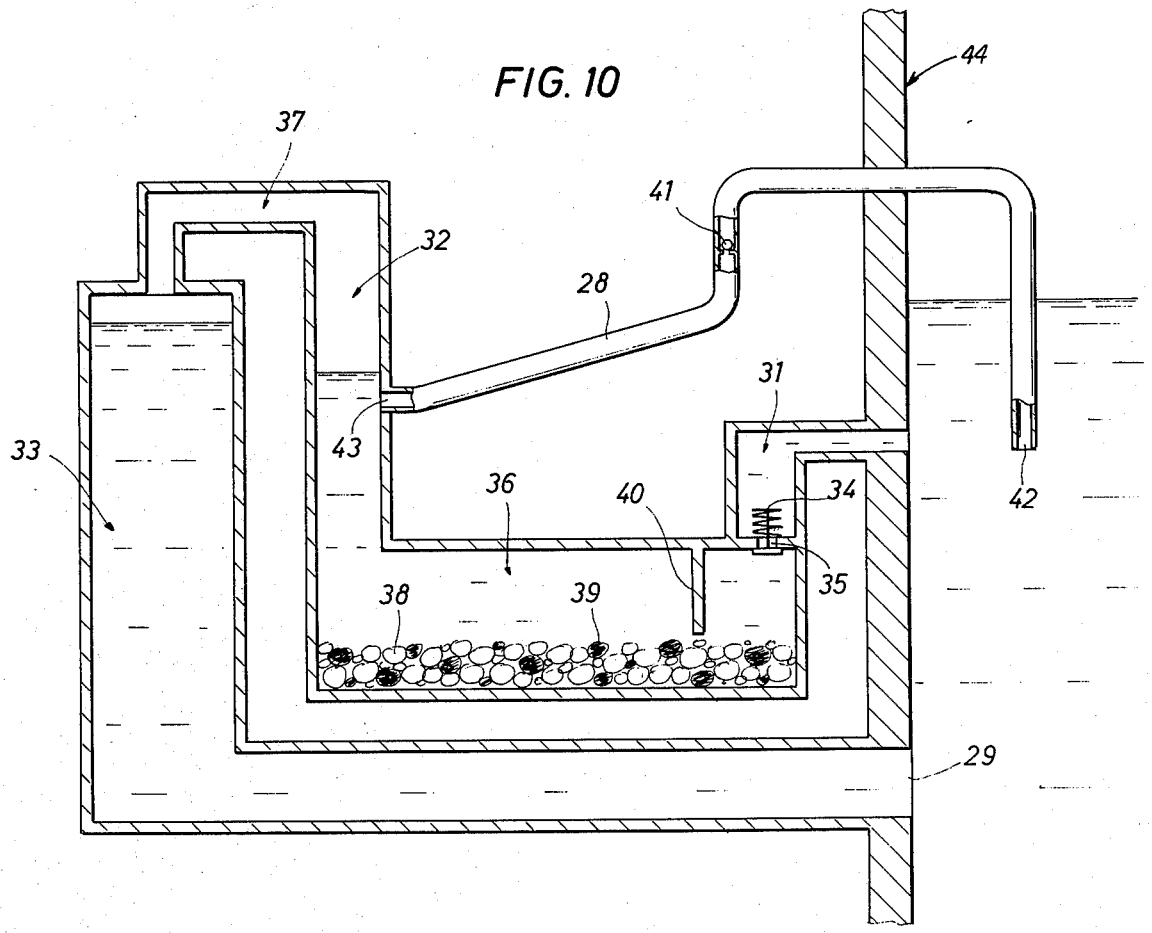
FIG. 10 is a vertical section view of an alternate means of installation wherein the apparatus is installed substantially outside of a tank containing a cycling fluid level.

FIG. 10 illustrates a mode of attachment wherein substantially all of the apparatus of this invention is located outside of a tank containing a cycling fluid level. In this mode, the siphon discharge tube 28, refill chamber 31 and the pump chamber 33 comunicate to the fluid in the tank through tank wall 44.

In generic terms this invention is an apparatus for delivering measured amounts of chemical solution upon actuation of a cycling fluid level which comprises:

a. a solids chamber 36 adapted to contain solid soluble chemical 38 or a mixture of solid soluble chemicals 38 and ballast material 39 and optionally having at least one baffle 40 attached to the top of said solids chamber 36 and extending downwardly into said solids chamber 36 to a point above but not contacting the solid soluble chemicals 38, said baffle 40 further extending across the width of said solids chamber 36 in a direction intersecting the direction of fluid flow within said solids chamber 36, b. a liquid refill chamber 31 having an open top and situated above the top of said solids chamber 36, c. first means for providing fluid communication between said refill chamber 31 and said solids chamber 36 which permits fluid flow from said refill chamber 31 into said solids chamber 36 and which prevents reverse fluid flow from said solids chamber 36 into said refill chamber 31, d. a discharge chamber 32 extending above the top of said solids chamber 36, e. second means for providing fluid communication between said discharge chamber 32 and said solids chamber 36, f. a pump chamber 33 having an open bottom portion and a top portion extending above the top of said solids chamber 36, g. third means for providing fluid communication between the top of said pump chamber 33 and the top of said discharge chamber 32, h. a siphon tube 28 having an inlet end 41 into said discharge chamber 32 at a point between said second and third means, having a portion of said siphon tube 28 extending above the inlet 41 and having an outlet end 42 located below the inlet end 41, i. fourth means for preventing reverse fluid flow from the outlet 42 of said siphon tube 28 to the inlet 41 of said siphon tube 28.

In a preferred embodiment, this invention provides for an apparatus for delivering measured amounts of chemical solution to the trap of a toilet bowl upon actuation by the flushing cycle of the toilet which comprises:

a. a solids chamber 36 adapted to certain solid soluble chemicals 38 or a mixture of solid soluble chemicals 38 and ballast material 39, and optionally having at least one baffle 40 attached to the top of said solids chamber 36 and extending downwardly into said solids chamber 36 to a point above but not contacting the solid soluble chemicals 38, and/or 39, said baffle 40 further extending across the width of said solids chamber in a direction intersecting the direction of fluid flow within said solids chamber 36, b. a refill chamber 31 having an open top end situated above the top of said solids chamber 36, c. first means for providing fluid communication between said refill chamber 31 and said solids chamber 36, d. a check valve 34, which permits fluid flow from said refill chamber 31 through said first means into said solids chamber 36 and which prevents fluid flow from said solids chamber 36 through said first means into said refill chamber 31, and e. a discharge chamber 32 extending above the top of said solids chamber 36, f. second means for providing fluid communication between said discharge chamber 32 and said solids chamber 36, g. a pump chamber 33 having an open bottom portion and a top portion extending above the top of said discharge chamber 32, h. third means for providing fluid communication between the top of said pump chamber 33 and the top of said discharge chamber 32, i. a siphon tube 28 having an inlet end 41 into said discharge chamber 32 at a point between said second and third means, having a portion of said siphon tube 28 extending above the inlet 41 and having the outlet end 42 inserted into the overflow pipe 16 of a toilet with the outlet 42 of said siphon tube 28 located below the inlet end 41 and further located within about four inches from the bottom of the overflow pipe 16.

The invention described in this specification also includes a process for delivering metered amounts of chemicals using the apparatus described herein.

The solid, soluble chemical employed in the apparatus of this invention may constitute a deodorant, a sterilizing agent, a cleansing agent, a perfuming agent or any other desired soluble material, or may consist of a combination of soluble chemicals as occasion may require.

While specific embodiments of the invention have been shown and described, various details of construction may be employed as occasion may require and are still considered as coming within the meaning and scope of the invention.

We claim as our invention:

1. An apparatus for delivering measured amounts of chemical solution upon actuation of a cycling fluid level which comprises:

a. a solids chamber adapted to contain solid soluble chemicals or a mixture of solid soluble chemicals and ballast material, b. a refill chamber having an open top end situated above the top of said solids chamber, c. first means for providing fluid communication between said refill chamber and said solids chamber which permits fluid flow from said refill chamber into said solids chamber and which prevents reverse fluid flow from said solids chamber into said refill chamber, d. a discharge chamber extending above the top of said solids chamber, e. second means for providing fluid communication between said discharge chamber and said solids chamber, f. a pump chamber having an open bottom portion and a top portion extending above the top of said solids chamber, g. third means for providing fluid communication between the top of said pump chamber and the top of said discharge chamber, h. a siphon tube having an inlet end into said discharge chamber at a point between said second and third means, having a portion of said siphon tube extending above the inlet and having an outlet end located below the inlet end.

2. The apparatus of claim 1 wherein said solids chamber has at least one baffle attached to the top of said solids chamber and extending downwardly into said solids chamber to a point above but not contacting the solid soluble chemicals, said baffle further extending across the width of said solids chamber in a direction interecting the direction of fluid flow within said solids chamber.

3. The apparatus of claim 1 whereby said first means is a check valve.

4. The apparatus of claim 1 further comprising a fourth means for preventing reverse fluid flow from the outlet of said siphon tube to the inlet of said siphon tube.

5. The apparatus of claim 4 whereby said fourth means is a check valve.

6. An apparatus for delivering measured amounts of chemical solution to trap of a toilet bowl upon actuation by the flushing cycle of the toilet which comprises:

a. a solids chamber adapted to certain solid soluble chemicals or a mixture of solid soluble chemicals and ballast material, b. a refill chamber having an open top end situated above the top of said solids chamber, c. first means for providing fluid communication between said refill chamber and said solids chamber, d. a check valve which permits fluid flow from said refill chamber through said first means into said solids chamber and which prevents fluid flow from said solids chamber through said first means into said refill chamber, e. a discharge chamber extending above the top of said solids chamber, f. second means for providing fluid communication between said discharge chamber and said solids chamber, g. a pump chamber having an open bottom portion and a top portion extending above the top of said discharge chamber, h. third means for providing fluid communication between the top of said pump chamber and the top of said discharge chamber, i. a siphon tube having an inlet end into said discharge chamber at a point between said second and third means, having a portion of said siphon tube extending above the inlet and having the outlet end suitable for inserting into the overflow pipe at a toilet with an outlet of said siphon tube located below the inlet end and further located within about four inches from the bottom at the overflow pipe.

7. The apparatus of claim 6 wherein said solids chamber has at least one baffle attached to the top of said solids chamber and extending downwardly into said solids chamber to a point above but not contacting the solid soluble chemicals, said baffle further extending across the width of said solids chamber in a direction intersecting the direction of fluid flow within said solids chamber.

* * * * *